US010480773B2

(12) United States Patent
Corkill et al.

(10) Patent No.: US 10,480,773 B2
(45) Date of Patent: Nov. 19, 2019

(54) CANOPY LIGHT HAVING MOISTURE CONTROL

(71) Applicant: Jarvis Corp., Elk Grove Village, IL (US)

(72) Inventors: Kirby Corkill, Chicago, IL (US); Sawyer Hopps, Chicago, IL (US); Lauren Strandberg, Mount Prospect, IL (US); Adam Broda, Harwood Heights, IL (US)

(73) Assignee: Jarvis Corp., Elk Grove Village, IL (US)

( * ) Notice: Subject to any disclaimer, the term of this patent is extended or adjusted under 35 U.S.C. 154(b) by 340 days.

(21) Appl. No.: 15/360,475

(22) Filed: Nov. 23, 2016

(65) Prior Publication Data

US 2018/0142881 A1 May 24, 2018

(51) Int. Cl.

| | |
|---|---|
| ***F21V 31/03*** | (2006.01) |
| ***F21V 15/01*** | (2006.01) |
| ***F21V 31/00*** | (2006.01) |
| ***F21W 131/10*** | (2006.01) |
| ***F21V 29/76*** | (2015.01) |

(Continued)

(52) U.S. Cl.

CPC ..... *F21V 31/03* (2013.01); *F21V 15/01* (2013.01); *F21V 17/101* (2013.01); *F21V 29/763* (2015.01); *F21V 31/005* (2013.01); *F21V 33/006* (2013.01); *F21W 2131/10* (2013.01)

(58) Field of Classification Search

CPC ..... F21V 31/03; F21V 31/005; F21V 15/01; F21V 33/006; F21W 2131/10; F21S 8/026; F21S 8/04; F21S 8/043

See application file for complete search history.

(56) References Cited

U.S. PATENT DOCUMENTS

| | | | | |
|---|---|---|---|---|
| 3,788,206 A * | 1/1974 | Mulvey | ..... | F21S 8/02 362/260 |
| 4,658,339 A * | 4/1987 | Tammerijn | ..... | F21S 8/04 362/294 |

(Continued)

*Primary Examiner* — Bryon T Gyllstrom
*Assistant Examiner* — James M Endo
(74) *Attorney, Agent, or Firm* — Jovan N. Jovanovic; The Watson IP Group PLC

(57) ABSTRACT

A canopy light including a frame, a venting cap, an electrical assembly and a light transcending cover. The frame has a cavity defined by a base and an upstanding structure defining an upper perimeter edge. A component cavity venting system includes a drainage chamber in communication with the cavity through a communicating port. The drainage chamber has an ingress opening. A drain opening is isolated from the communicating port, to allow drainage from the drainage chamber, while substantially preclude the passage of a fluid through the drain opening, into the drainage chamber and through the communicating port into the cavity. The venting cap extends over the ingress opening of the drainage chamber, substantially sealing the same. The electrical assembly includes a power supply and at least one LED light assembly, positionable within the cavity. The light transcending cover extends over the cavity of the frame about the upper perimeter edge, and structurally configured to permit at least some of the light generated by the LED light assembly to be directed therethrough.

18 Claims, 7 Drawing Sheets

(51) Int. Cl.
*F21V 17/10* (2006.01)
*F21V 33/00* (2006.01)

(56) References Cited

U.S. PATENT DOCUMENTS 6,352,358 B1 * 3/2002 Lieberman ..... F21V 15/00 362/294
6,565,238 B1 * 5/2003 Pyrtle ..... F21S 8/02 362/218
6,728,480 B1 * 4/2004 Maeda ..... G03B 17/08 348/373
7,040,782 B2 * 5/2006 Mayer ..... F21V 7/0008 362/297
8,556,475 B2 * 10/2013 Hochstein ..... F21V 15/00 362/373
2007/0159849 A1 * 7/2007 Sakai ..... G02F 1/133603 362/612
2008/0137350 A1 * 6/2008 Tian ..... B63B 45/00 362/362
2011/0026249 A1 * 2/2011 Wylde ..... F21S 8/086 362/240
2011/0122616 A1 * 5/2011 Hochstein ..... F21V 15/01 362/235
2011/0156587 A1 * 6/2011 Wu ..... F21V 23/02 315/35
2013/0025457 A1 * 1/2013 Furuuchi ..... F21V 31/03 96/4
2013/0135874 A1 * 5/2013 Hofmann ..... F21V 15/01 362/294
2013/0258660 A1 * 10/2013 Kim ..... F21V 21/00 362/235
2014/0078718 A1 * 3/2014 Li ..... F24F 7/007 362/96
2014/0247603 A1 * 9/2014 Cruz ..... F21S 8/033 362/311.01
2015/0062873 A1 * 3/2015 Berg ..... F21V 31/005 362/101
2015/0167900 A1 * 6/2015 McConnell ..... F21K 9/20 362/370

* cited by examiner

CANOPY LIGHT HAVING MOISTURE CONTROL

CROSS-REFERENCE TO RELATED APPLICATION

N/A

BACKGROUND OF THE DISCLOSURE

1. Field of the Disclosure

The disclosure relates in general to lighting assemblies, and more particularly, to a canopy light having moisture control. It will be understood that such a light is configured for use in association with a number of different structures, and not limited for use in association with a canopy. However, the canopy light is well suited for use in association with the lighting of a canopy by coupling to a lower surface of the canopy.

2. Background Art

The use of canopy lights is known in the art. While there is no particular limit to applications, such canopy lights are, for example, utilized in association with gas station canopies. In such an environment, the canopy lights are exposed to the outside elements, including water in the form of cleaning fluids, as well as rain, sleet and snow. Thus, it is necessary to preclude the entry of moisture into the canopy light, as such moisture may damage the electronics within the light.

However, it is difficult to seal such structures, as the heat generated by the LED lights increases the pressure within the cavity of the light. Then when the light is turned off, the pressure reduces. This results in a pressure cycling within the cavity of the light. In such instances it is desirable to vent the excess pressure to the outside.

Problematically, the need to vent the cavity due to the pressure cycling and the need to limit ingress of moisture and fluid into the cavity impose difficult design considerations. In many instances, multiple structures are formed and coupled together in order to isolate each of these design requirements. For example, the light elements and the remainder of the electronic components (power supply and surge protector) may be isolated from each other and in separate structures which are coupled together. Additionally, due to limitations in the designs, many canopy lights are designed for increased internal pressure. While such a solution may be operatively acceptable, designing the components for increased internal pressure increases the complexity and the cost of such canopy lights.

SUMMARY OF THE DISCLOSURE

The disclosure is directed to A canopy light comprising a frame, a venting cap, an electrical assembly and a light transcending cover. The frame has a cavity defined by a base and an upstanding structure defining an upper perimeter edge. A component cavity venting system includes a drainage chamber in communication with the cavity through a communicating port. The drainage chamber has a ingress opening. A drain opening is isolated from the communicating port, to allow drainage from the drainage chamber, while substantially preclude the passage of a fluid through the drain opening, into the drainage chamber and through the communication port into the cavity. The venting cap extends over the ingress opening of the drainage chamber, substantially sealing the same. The electrical assembly includes a power supply and at least one LED light assembly, positionable within the cavity. The light transcending cover extends over the cavity of the frame about the upper perimeter edge, and structurally configured to permit at least some of the light generated by the LED light assembly to be directed therethrough.

In some configurations, the drainage chamber is defined in part by the upstanding structure, so as to be integrally formed with the frame.

In some configurations, the upstanding structure defines a rectangular configuration, with a corner incline surface positioned in each corner of the rectangular configuration. In such a configuration, each corner incline surface angled relative to a front surface of the base and to the upstanding structure. An LED light assembly mounted on each of the corner inclined surfaces.

In some configurations, each corner incline surface is angled relative to the upstand and the base at an angle of between 10° and 80°.

In some configurations, the canopy light further comprises a reflector positioned between the frame and the light transcending cover.

In some configurations, the component cavity venting system further includes a lower passageway formed into a base of the frame which is placeable in fluid communication with the communicating port.

In some configurations, the communicating port extends through the upstanding structure.

In some configurations, the drainage chamber includes an end wall, and opposing side walls. The drain opening is defined in the end wall.

In some configurations, the frame is formed from a single monolithic cast member.

In some configurations, the light transcending cover is adhered to the frame about the upper perimeter edge.

In some configurations, the venting cap comprises an elastomeric member having an adhesive applied thereto.

In some configurations, the elastomeric member comprises a foam adhesive member.

In some configurations, the frame includes a conduit entry opening defined in the base thereof. The conduit entry opening further includes an elongated channel extending away from a back surface of the base.

In some configurations, the venting cap extends about the elongated channel of the conduit entry opening.

In some configurations, the frame further includes a perimeter drainage structure extending about the upstanding structure.

In some configurations, the perimeter drainage structure comprises an outer fascia, which, cooperatively with the upstanding structure defines an inner trough, with a drain opening extending therethrough.

In some configurations, the outer fascia further includes a plurality support fins extending inwardly within the inner trough.

In some configurations, the base further includes a plurality of cooling fins extending outwardly from a back surface thereof.

BRIEF DESCRIPTION OF THE DRAWINGS

The disclosure will now be described with reference to the drawings wherein.

DETAILED DESCRIPTION OF THE DISCLOSURE

Figure 1:
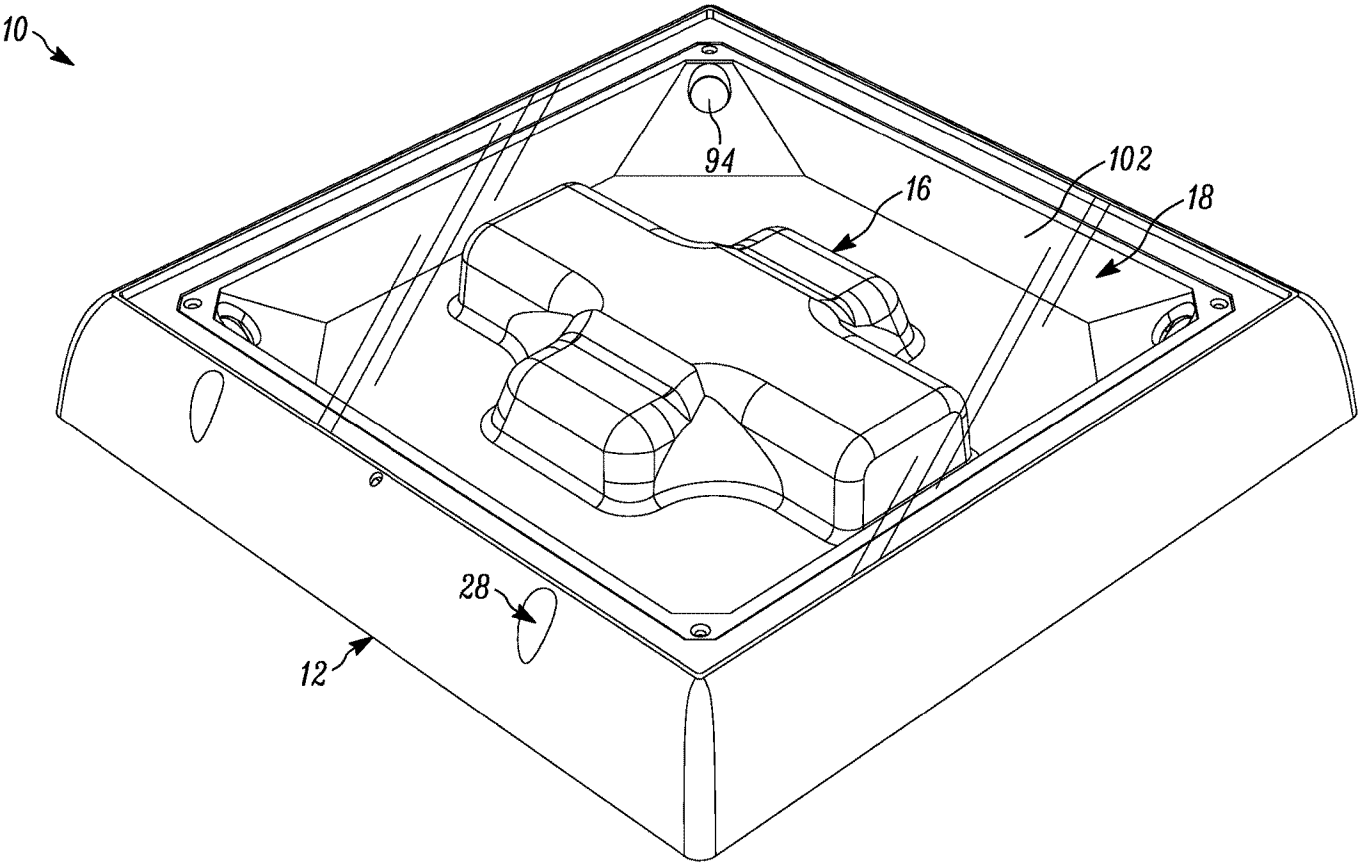
FIG. 1 of the drawings is a top perspective view of the canopy light of the present disclosure.
Figure 2:
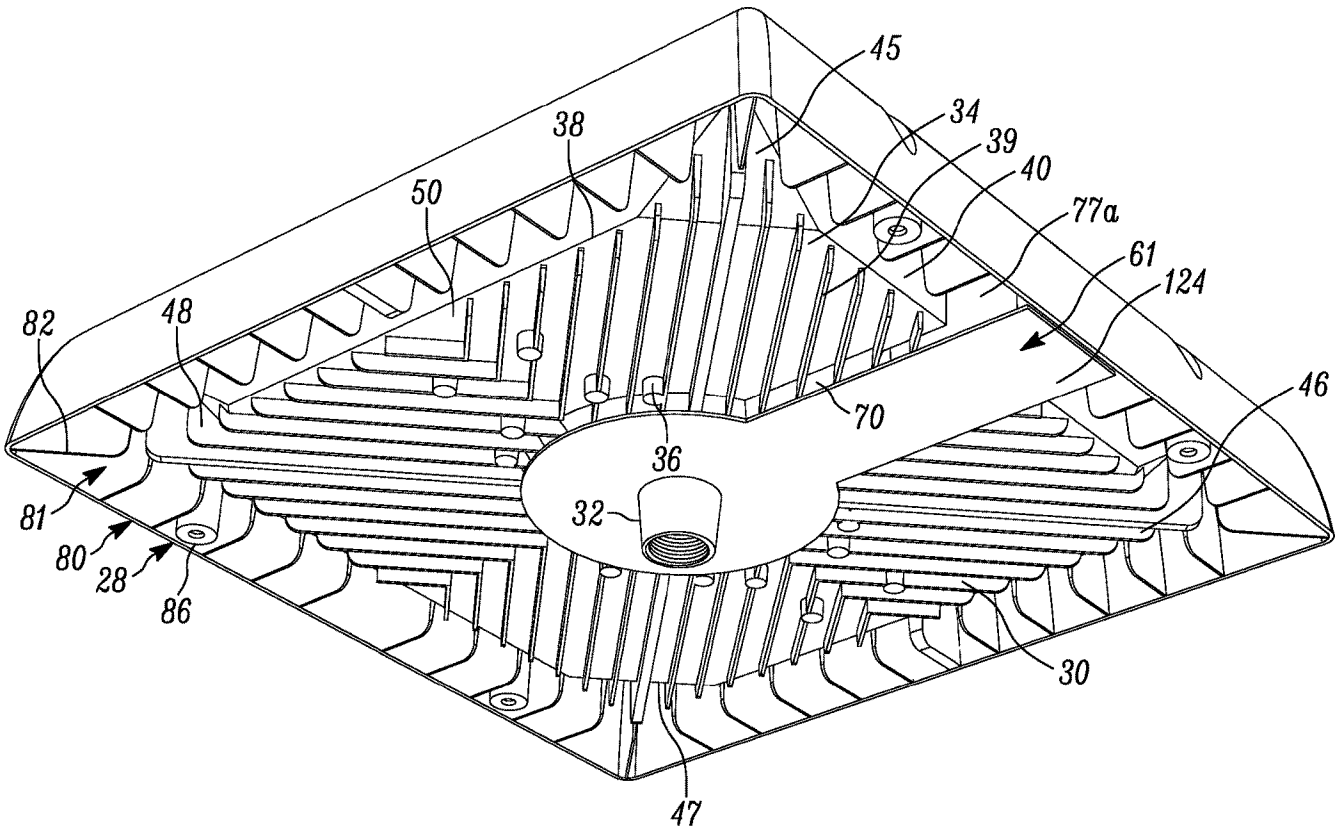
FIG. 2 of the drawings is a bottom perspective view of the canopy light of the present disclosure.
Figure 3:
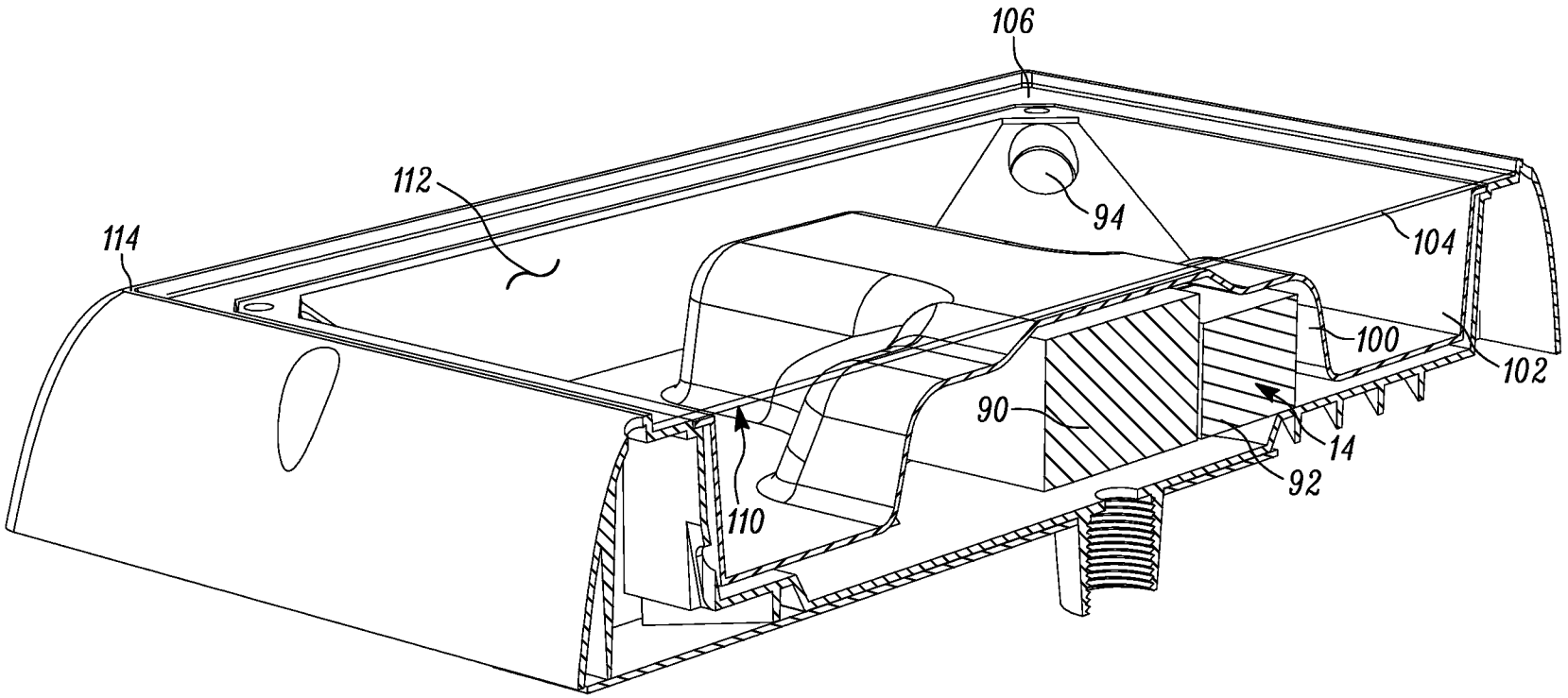
FIG. 3 of the drawings is a cross-sectional perspective view of the canopy light of the present disclosure.
Figure 4:
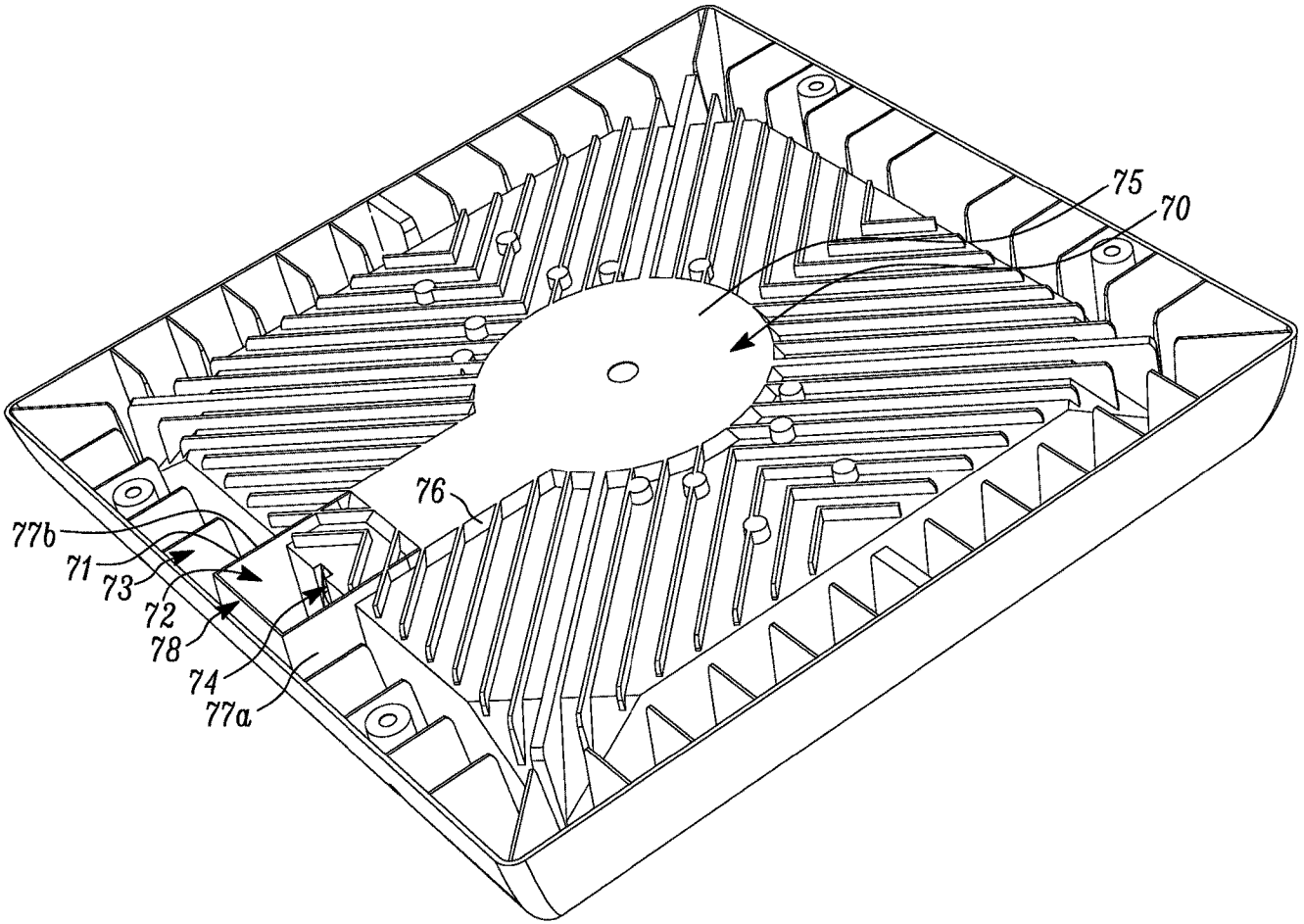
FIG. 4 of the drawings is a bottom cross-sectional view of the canopy light of the present disclosure.
Figure 5:
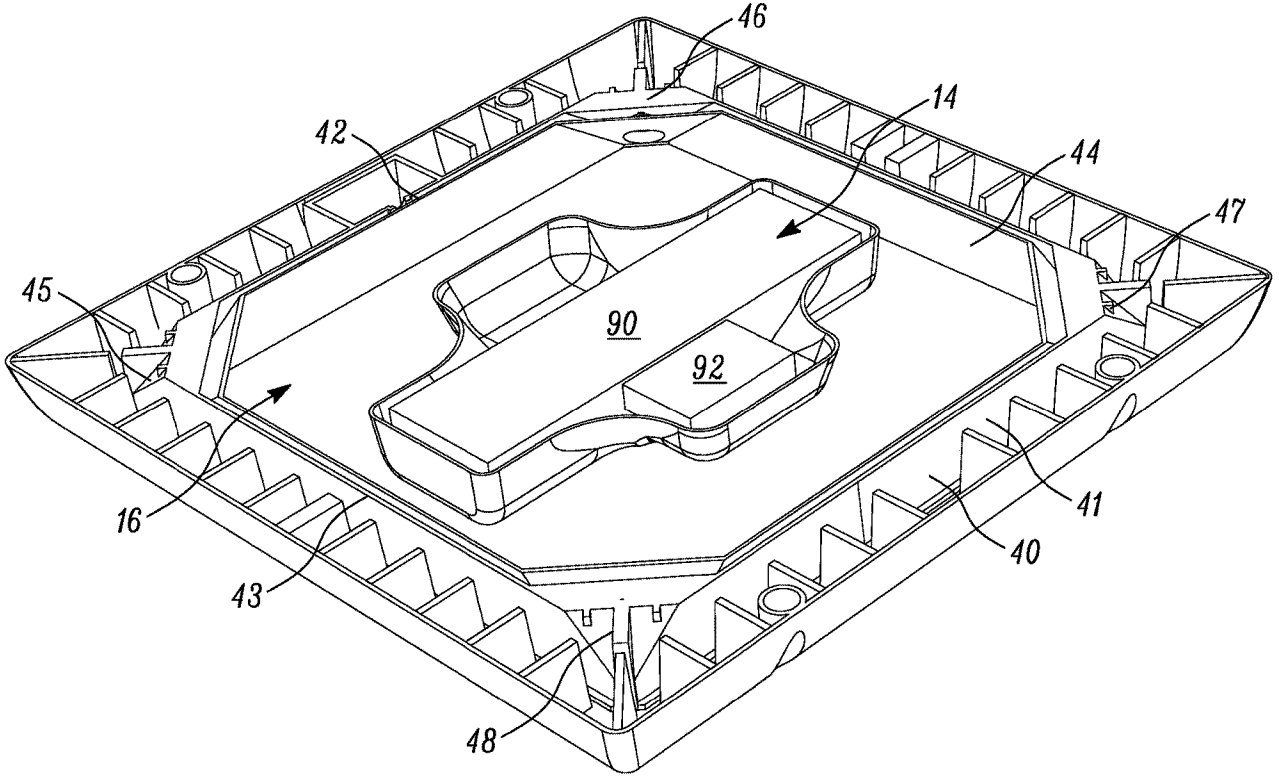
FIG. 5 of the drawings is a middle cross-sectional view of the canopy light of the present disclosure.
Figure 6:
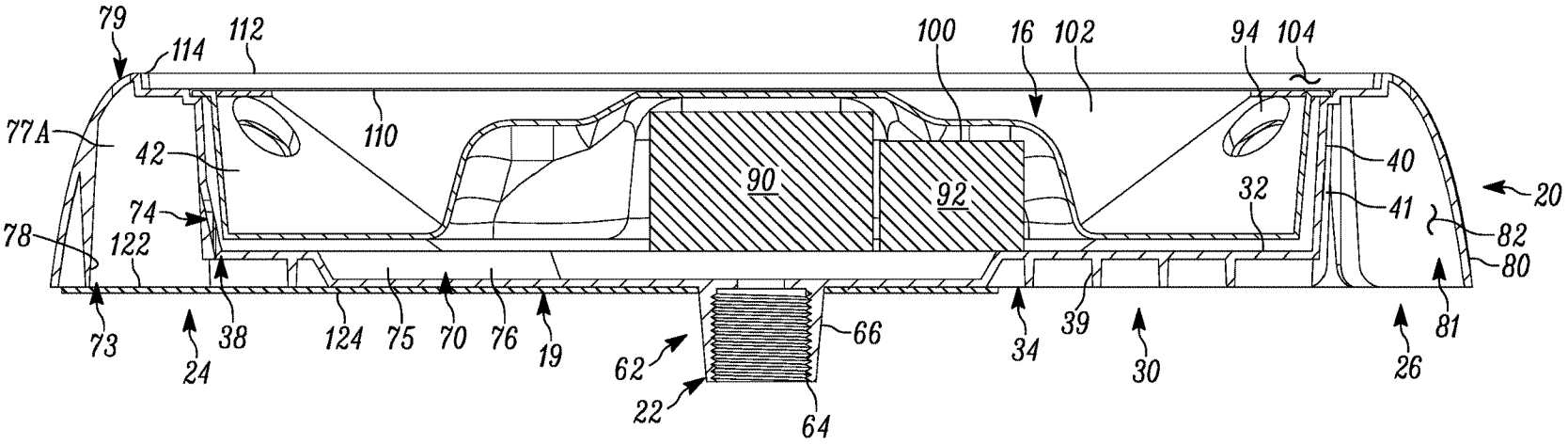
FIG. 6 of the drawings is a cross-sectional view of the canopy light of the present disclosure.
Figure 7:
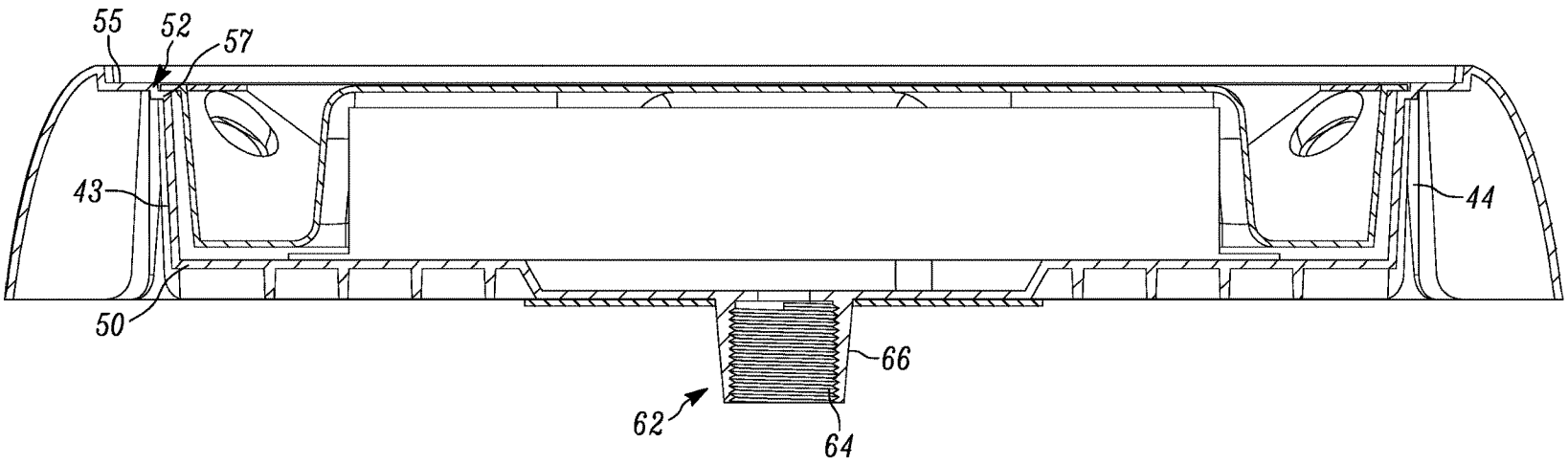
FIG. 7 of the drawing is a cross-sectional view of the canopy light of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the canopy light having moisture control is shown generally at 10. The canopy light 10 includes frame 12, electrical assembly 14, reflector 16, light transcending cover 18, and venting cap member 19. While the canopy light can be used in any application where illumination is desired, the canopy light is particularly well suited for use in association with lighting under a canopy, such as a canopy that is typically associated with a gas service station. Typically, such a station includes an overhead canopy that extends over the gas pumps to allow a patron to fill the tank of his or her car while staying dry if there is precipitation, and/or to stay out of the direct sunlight. Such canopies generally comprise a frame formed by a plurality of beams which beams are encased on the sides and the lower surface with a sheeting material, such as a sheet metal. Canopy lights are typically coupled to the lower surface and conduit extends through the lower surface and into the canopy light from above. Of course, the use of the canopy light is not limited to use in association with a canopy, per se, or to a canopy of, for example, a service station. Indeed, the canopy light can be used in other environments, including, but not limited to environments wherein the canopy light is coupled to a ceiling or an overhead surface.

The frame 12 includes component cavity 20, conduit entry 22, component cavity venting system 24, perimeter drainage 26 and outside attachment structure 28. The frame 12, in the configuration shown, comprises a single monolithic cast member, such as an aluminum casting. In other configurations, the frame 12 may comprise a material other than aluminum, and may comprise a metal, alloy thereof, a polymer based member, or a composite member. Advantageously, the frame of the present disclosure, can be formed and be fully operational as a single casting, which dramatically reduces production and assembly costs.

The component cavity 20 includes base 30 and upstanding structure 40. The base 30 includes front surface 32 and back surface 34. The front and back surfaces generally are substantially planar (with variations such as the component cavity venting system and other structures), and generally of a rectangular (and preferably square configuration) with beveled corners (so as to facilitate the defining of the corner inclines). The base 30 defines an outer perimeter 38. The base includes a plurality of cooling fins, such as cooling fins 39 that extend outwardly from the back surface 34. As can be seen, a number of different cooling fins, in a number of different orientations and relative orientations are disposed on the back surface. Additionally, the base 30 includes a plurality of bores, such as bore 36, which are configured to receive threaded fasteners. In some configurations, the bore may be tapped, whereas in other configurations, the fastener may comprise a self-tapping fastener.

The upstanding structure 40 includes a plurality of sidewalls, including first sidewall 41, second sidewall 42, third sidewall 43 and fourth sidewall 44. The sidewalls are preferably substantially perpendicular to the base 30 and extend upwardly about the perimeter of the base 30 (except along the beveled portions of the base). A plurality of corner incline surfaces, namely, first corner incline surface 45, second corner incline surface 46, third corner incline surface 47 and forth corner incline surface 48 extend between adjacent sidewalls and the base, so as to define generally triangular surfaces. In the configuration shown, the corner incline surfaces extend at an angle of 45° relative to the base projection (or 135° relative to the base 30). Of course, other configurations contemplate different inclined angles of these surfaces, such as inclinations of between 10° and 80°, or more preferably between 30° and 60°. In still other configurations, the corner incline surfaces may be omitted and spacers or the like can be utilized in the corners of the component cavity so as to provide a surface upon which to mount the LED elements.

The upstanding structure 40 defines a lower perimeter edge 50 and an upper perimeter edge 52. At the upper edge 52, a reflector mounting ledge 57 and a mounting surface 55 are defined. The reflector mounting ledge provides a substantially planar surface rim upon which the reflector can rest. A plurality of bores extend into the upstanding structure which are configured to receive fasteners that can couple the reflector thereto. The mounting surface 55 provides a substantially planar surface that is substantially continuous about the upper perimeter edge 52. The mounting surface 55 provides a surface upon which the light transcending cover 18 can be mounted by way of adhesive or the like, for example, or through other means, such as clips, fasteners or the like.

The conduit entry structure comprises an elongated channel 62 extending from the back surface 34 of the base 30, in a manner that is generally perpendicular to the back surface, and generally centrally located thereon. The channel defines an inner surface 64 which meets an opening 60 defined in the back surface so as to place the channel in communication with the component cavity. The inner surface 64 may be threaded so as to be attachable to a conduit or the like. The channel further includes outer surface 66. The outer surface in the configuration shown comprises a generally round configuration, so that the elongated channel comprises a substantially cylindrical configuration. Of course, other configurations are contemplated, including other shapes and the like. In some configurations, the conduit entry may comprise the opening 60 defined in the base, and the opening may be threaded, for example. In other configurations, other mating structures, other than threads may be employed, such as snap fit structures and the like.

The component cavity venting system 24 comprises lower passageway 70, draining chamber 72 and communicating port 74. The lower passageway 70 is formed into the base 30 and includes base 75 and side walls 76 defining a trough in the base. The lower passageway 70 extends from the central region of the base (in the configuration shown, from a position surrounding the opening 60 of the conduit entry structure), to the first side wall 41 of the upstanding structure 40.

The draining chamber 72 is formed on an outer side of the upstanding structure, and utilizes the first sidewall as the inner wall thereof. An end wall 78 has an upper portion that is spaced apart therefrom, and curves to join the first sidewall at a lower end thereof, although variations are contemplated. As will be explained, portions of the end wall are formed by the perimeter drainage structure 26 and the upper flange 54. Opposing side walls 77*a*, 77*b* extend between the first sidewall and the end wall so as to define a cavity therebetween with an ingress opening 73 (defined by ingress opening edge 71) and a drain opening 79. In the configuration shown, the ingress opening is generally parallel with the base and rectangular/square in configuration. Of course, in other configurations, different shapes are contemplated. It is contemplated that the draining chamber may be formed in different configurations and may be formed from additional surfaces that are specifically suited for the formation of the chamber, rather than being integrated with the upstanding wall and the perimeter drainage structures.

A communicating port 74 is defined in the sidewall 41 and places the component cavity 30 in fluid communication with the draining chamber 72, and in particular, is positioned proximate the lower passageway 70 so that air can easily circulate, generally without substantial obstruction therebetween. The communicating port 74 may further include a tubular member that extends therethrough with an opening on either side of the communicating port 74 so as to preclude obstruction and so as to further limit the passage of air/vapor between the component cavity and the draining chamber.

It is contemplated that while a single component cavity venting system is shown, with a single drainage chamber, other structures are likewise contemplated for use. For example, the lower passageway may be directed to multiple chambers, and these chambers may be located on the same sidewall, or on different sidewalls, such as opposing sidewalls or adjacent sidewalls. It will further be understood that the lower passageway in some configurations may comprise a separate structure such as a tubular member that is in communication with the communicating port. In still other configurations, the lower passageway is not limited to a structure integrally formed with the base 30.

The perimeter drainage structure 26 comprises an outer fascia 80. The outer fascia provides an aesthetic finish to the frame, and in the configuration shown comprises a curved structure having an outwardly convex structure that has the appearance of a quarter round molding, for example. In other configurations, other outer configurations are contemplated, and the particular shape of the outer fascia can be modified depending on desired designs. In some configurations, the outer fascia may have a squared off appearance or the like. The outer fascia extends from the upper flange 54 of the upstanding structure and extends away from the sidewalls and toward the base, thereby defining an inner trough 81. The particular configuration of the inner trough 81 can be varied depending on the application and the particular ornamental appearance desired. To provide enhanced rigidity and to further facilitate the dissipation of heat, a plurality of support fins 82 extend from the outer fascia and into the inner trough 81. In the configuration shown, the fins stop short of contact with the sidewalls, and are generally perpendicular to the sidewalls. A drain opening 84 is defined in the outer fascia proximate the junction with the upstanding structure. It will be explained in the use of the device, below, that any moisture and water in the trough can be directed out through the drain opening 84.

The outside attachment structure 28 comprises a plurality of bores 86 that are strategically positioned so as to extend from the outer fascia into the trough in a manner that a fastener extended therethrough extends in a direction that is substantially parallel to the sidewalls and substantially perpendicular to the base. It will be understood that fasteners are extended through these bores and into an outside structure such as a wall, ceiling, canopy bottom wall and the like. In many instances, a self-tapping fastener is directed through the bore and into the outside structure to fasten the canopy light to the outside structure.

The electrical assembly 14 is shown in FIG. 1 as comprising power supply 90, surge protector 92 and LED light assembly 94. The power supply is mounted on the front surface 32 of the base with fasteners extending through openings in the power supply housing and into a plurality of the bores. Generally, the power supply is generally centrally located with a portion thereof straddling the lower passageway 70 of the component cavity venting system 24. The surge protector 92 is positioned proximate the power supply and as the power supply is coupled to the front surface 32 of the base with fasteners that extend into different ones of the bores 36 thereof. In some configurations, the power supply and the surge protector functions can be combined into a single device, as well as the functionality thereof. In other configurations, a surge protector can be omitted. The LED light assembly 94 is shown as being a COB (chip on board) LED's that include a combination of circuitry and LED elements. In the configuration shown, an LED in the form of a COB LED is positioned on each of the corner inclined surfaces, so as to face inwardly. It will be understood that electrical conductors join the LED's with the power supply and the surge protector, and the electrical conductors are attachable to other electrical conductors that are brought from an outside power source through the conduit entry structure 22 of the frame.

Reflector 16 is shown in FIG. 1 as comprising inner surface 100, outer surface 102, mounting edge 104 and openings 106. The reflector 16 generally follows the contours of the different components of the electrical assembly, with the outer surface 102 being metallized or polished so as to be reflective. The mounting edge 104 defines the perimeter of the reflector 16 and, when installed, engages with the reflector mating ledge 57 of the base 30 of the component cavity 20. The openings 106 correspond to the bores that extend into the upstanding structure so that fasteners can be inserted through the openings 106 and into those bores to couple the reflector to the frame. In the configuration shown, the reflector comprises a polymer material (such as a polycarbonate) which is metallized through, for example, a vapor deposition, or other process. In other configurations, the reflector may comprise a metal or alloy thereof that has a polished inner surface that reflects light. In still other configurations metallized structures may be utilized that are bonded to a substrate to form the reflector.

The light transcending cover 18 comprises a transparent or translucent member through which light can pass. In some configurations, the light transcending cover may include opaque structures or light directing structures, whereas in other configurations, the light transcending cover may be complete transparent. In the configuration shown, the cover has an inner surface 110 and an outer surface 112, which cooperatively define an outer perimeter 114. The inner surface 110 proximate the outer perimeter 114 is adhered, or otherwise secured to the frame at the mounting surface 55. Depending on the configuration, a number of different adhesives are contemplated, from flowable adhesives (i.e., liquids or gels), to tape type or more solid material adhesives. In some configurations, it is contemplated that the light transcending cover can be removed (i.e., the adhesive can be overcome) without destroying the transcending light cover, whereas in other configurations, any such removal would be destructive.

In the configuration shown, the light transcending cover 18 comprises a substantially planar member that is substantially uniform. In other configurations, the light transcending cover 18 may include light directing surface variations, may comprise a outwardly convex or concave configuration. In still other configurations, particular shapes may be defined in the light transcending cover.

The venting cap member 19 is shown as comprising foam adhesive member having an inner surface 122 and an outer surface 124. In the configuration shown, the venting cap member extends over the ingress opening edge so as to effectively seal the draining chamber. Additionally, in the configuration shown, the venting cap member extends about the elongated channel of the conduit entry structure. As the venting cap member comprises a foam adhesive, the venting cap member further provides a seal for the conduit as the venting cap member fully encircles the elongated channel of the conduit entry structure. In the configuration shown, the venting cap member 19 follows the contours of the base of the lower passageway, and continuing over the ingress opening edge. In other configurations, the venting cap member may comprise a resilient member that is glued or otherwise attached to the frame. A separate gasket or the like may be positioned or incorporated into the venting cap member. It will further be understood that the venting cap member may merely provide a cover over the draining chamber to effectively seal the same, while another member or component may extend about the elongated channel of the conduit entry.

In operation, the canopy light of the present disclosure is attachable to an outside surface. For example, and not being limited thereto, the light canopy of the present disclosure can be coupled to a lower surface of a gas station canopy. Typically, the canopy light is coupled to the lower surface of such a canopy by providing an opening through which the elongated channel 62 can extend. The elongated channel is extended until the back surface 34 abuts the lower surface of the canopy. The venting cap, which includes a foam adhesive or the like is activated (i.e., the backing thereof can be removed to expose the adhesive). The venting cap can then be abutted to the lower surface of the canopy so as to be coupled thereto. Additionally, it will be understood that the venting cap in the configuration shown extends about the elongated channel 62 of the frame so as to effectively seal the same from moisture.

Once positioned, a plurality of fasteners can be extended through the plurality of bores 86 of the outside attachment structure 28 and into the lower canopy. In the configuration shown, such fasteners may comprise self-tapping fasteners. Once positioned and attached, a conduit containing conductors from an outside power source (i.e., a generator or line power) can be attached with the conductors coupled to the electrical assembly through the surge protector and the power supply.

The operation of the canopy light of the present disclosure has certain advantages. First, the position of the LED light elements is in proximate the corners and is disposed as an angle of 45° greatly increasing the optical density at steeper approach angles. This increases the visibility of the light fixture. Additionally, the position of the LED light elements in the corner thermally isolates each LED as much as possible. Furthermore, the optical emissions angle is substantially maximized by such a configuration.

It is understood that the operation of the canopy light generates heat from the components. As a result it is necessary to vent the structure to preclude the buildup of pressure within the cavity of the frame, which can be destructive to the operation of the canopy light. However, it is also necessary to preclude the entry of moisture directly onto the components. The configuration of the component cavity venting system allows for such pressure equalization. For example, any heat related increase in pressure creates a pressure difference between the cavity and the ambient outside air. As such, air is pushed out of the cavity, by being directed through the lower passageway 70 to the communicating port 74 and into the draining chamber. Eventually, any such air exits through the drain opening 79.

It will be understood that when either rainwater, or cleaning water streams from a hose, water spray or otherwise is directed at the canopy light, any entering water that enters into the drain chamber will generally remain within the drain chamber as the communicating portion is spaced apart from the drain opening. Any such water, with the aid of gravity will exit through the drain opening as well. As such, while pressure equalization is facilitated, moisture is precluded from reaching the cavity and the electrical assembly thereof. It will be understood that, due to the isolation of the communicating port from the drain opening, it is not necessary to utilize a barrier film to isolate the cavity from the draining chamber. In many configurations, Teflon films or the like are utilized to preclude the passage of water between a cavity and the outside. However, it has been found that such an additional component is not required (although can be utilized if desired).

Furthermore, by utilizing a separate venting cap that seals the ingress opening, the frame can be made of a single monolithic configuration (i.e., a single casting). As such, moisture entry through an area other than the drain opening 79 is minimized due to the fewer components. Still further, the venting cap 19 can be utilized not only to seal the draining chamber, but also to provide seal about the conduit entry 22.

The additional inclusion of the perimeter draining structure provides an attractive outward configuration of the perimeter of the canopy light. It will be understood that any moisture, or fluid that collects within the perimeter draining structure will eventually (if the levels rise to a flowable quantity) be directed through the inner trough 81 and through the drain opening 84.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A canopy light comprising:

a frame having a cavity defined by a base and an upstanding structure defining an upper perimeter edge, and a component cavity venting system including a drainage chamber in communication with the cavity through a communicating port, the drainage chamber having a ingress opening, a drain opening isolated from the communicating port, to allow drainage from the drainage chamber, while substantially preclude the passage of a fluid through the drain opening, into the drainage chamber and through the communicating port into the cavity;

a venting cap extending over and substantially sealing the ingress opening of the drainage chamber;

an electrical assembly including a power supply and at least one LED light assembly, positionable within the cavity; and a light transcending cover extending over the cavity of the frame about the upper perimeter edge, and structurally configured to permit at least some of the light generated by the LED light assembly to be directed therethrough;

wherein the upstanding structure defines a polygonal configuration, with a corner incline surface positioned in each corner of the polygonal configuration, each corner incline surface angled between 10° and 80° relative to a projection of the base, with the at least one LED light assembly mounted on each of the corner inclined surfaces.

2. The canopy light of claim 1 wherein the drainage chamber is defined in part by the upstanding structure, so as to be integrally formed with the frame.

3. The canopy light of claim 1 wherein the polygonal configuration defines a rectangular configuration.

4. The canopy light of claim 1 further comprising a reflector positioned between the frame and the light transcending cover.

5. The canopy light of claim 1 wherein the component cavity venting system further includes a lower passageway formed into the base of the frame which is placeable in fluid communication with the communicating port.

6. The canopy light of claim 5 wherein the communicating port extends through the upstanding structure.

7. The canopy light of claim 6 wherein the drainage chamber includes an end wall, and opposing side walls, wherein the drain opening is defined in the end wall.

8. The canopy light of claim 1 wherein the frame is formed from a single monolithic cast member.

9. The canopy light of claim 1 wherein the light transcending cover is adhered to the frame about the upper perimeter edge.

10. The canopy light of claim 1 wherein the venting cap comprises an elastomeric member having an adhesive applied thereto.

11. The canopy light of claim 10 wherein the elastomeric member comprises a foam adhesive member.

12. The canopy light of claim 1 wherein the frame includes a conduit entry opening defined in the base thereof, the conduit entry opening further including an elongated channel extending away from a back surface of the base.

13. The canopy light of claim 12 wherein the venting cap extends about the elongated channel of the conduit entry opening.

14. The canopy light of claim 1 wherein the frame further includes a perimeter drainage structure extending about the upstanding structure.

15. The canopy light of claim 14 wherein the drain opening is a first drain opening and the perimeter drainage structure comprises an outer fascia, which, cooperatively with the upstanding structure defines an inner trough, with a second drain opening extending through the outer fascia.

16. The canopy light of claim 15 wherein the outer fascia further includes a plurality support fins extending inwardly within the inner trough.

17. The canopy light of claim 1 wherein the base further includes a plurality of cooling fins extending outwardly from a back surface thereof.

18. A canopy light comprising:

a frame having a cavity defined by a base and an upstanding structure defining an upper perimeter edge, a perimeter drainage structure extending around the upstanding structure, and a component cavity venting system including a drainage chamber in communication with the cavity through a communicating port, the drainage chamber having a ingress opening, a first drain opening isolated from the communicating port, to allow drainage from the drainage chamber, while substantially preclude the passage of a fluid through the first drain opening, into the drainage chamber and through the communicating port into the cavity;

a venting cap extending over and substantially sealing the ingress opening of the drainage chamber;

an electrical assembly including a power supply and at least one LED light assembly, positionable within the cavity; and a light transcending cover extending over the cavity of the frame about the upper perimeter edge, and structurally configured to permit at least some of the light generated by the LED light assembly to be directed therethrough;

wherein the perimeter drainage structure comprises an outer fascia, an inner trough defined by the outer fascia and the upstanding structure, and a second drain opening extending through the outer fascia to direct water in the inner trough through the second drain opening.

* * * * *